US008397679B2

(12) United States Patent
Kozaki

(10) Patent No.: US 8,397,679 B2
(45) Date of Patent: Mar. 19, 2013

(54) LIQUID LEVEL CONTROL SYSTEM

(75) Inventor: Tatsuro Kozaki, Mito (JP)

(73) Assignee: Hitachi, Ltd., Tokyo (JP)

( * ) Notice: Subject to any disclaimer, the term of this patent is extended or adjusted under 35 U.S.C. 154(b) by 756 days.

(21) Appl. No.: 12/618,008

(22) Filed: Nov. 13, 2009

(65) Prior Publication Data

US 2010/0126433 A1 May 27, 2010

(30) Foreign Application Priority Data

Nov. 21, 2008 (JP) ..... 2008-298767

(51) Int. Cl.
*F22B 37/46* (2006.01)

(52) U.S. Cl. ..... 122/488; 122/505; 73/305

(58) Field of Classification Search ..... 122/34, 122/488, 489, 491, 492, 505; 73/305, 322.5, 73/290 R, 291
See application file for complete search history.

(56) References Cited

U.S. PATENT DOCUMENTS

| | | | | |
|---|---|---|---|---|
| 3,193,468 | A * | 7/1965 | Sprague | 376/378 |
| 4,385,908 | A * | 5/1983 | Carmichael | 95/24 |
| 4,445,462 | A | 5/1984 | Mastronarde | |
| 4,472,355 | A * | 9/1984 | Hickam et al. | 422/62 |
| 5,279,158 | A | 1/1994 | Teigen et al. | |
| 5,519,639 | A * | 5/1996 | Jordan et al. | 702/55 |
| 5,771,846 | A | 6/1998 | Ruchti | |
| 6,336,429 | B1 * | 1/2002 | Wiener et al. | 122/488 |
| 7,628,067 | B2 * | 12/2009 | Yoshinari et al. | 73/304 C |
| 2006/0120502 | A1 | 6/2006 | Tomiki et al. | |
| 2007/0076838 | A1 | 4/2007 | Tomiki et al. | |
| 2009/0159018 | A1 | 6/2009 | Mehendale et al. | |
| 2012/0255353 | A1 * | 10/2012 | Kozaki et al. | 73/305 |

FOREIGN PATENT DOCUMENTS

| | | | |
|---|---|---|---|
| DE | 195 10 619 | A1 | 9/1996 |
| JP | 4-178599 | A | 6/1992 |
| JP | 5-172991 | A | 7/1993 |
| JP | 5-240997 | A | 9/1993 |
| JP | 5-265569 | A | 10/1993 |
| JP | 6-123797 | A | 5/1994 |

OTHER PUBLICATIONS

Kastner et al.; "Verbesserte Speisewasserregelung Durch Kompaktes Messsystem Zur Massenstromund Dampfgehaltsbestimmung"; BWK Brennstoff Warme Kraft, Springer VDI Verlag, Dusseldorf, DE, vol. 45, No. 12, Dec. 1, 1993, pp. 510-514.

* cited by examiner

*Primary Examiner* — Gregory A Wilson
(74) *Attorney, Agent, or Firm* — Mattingly & Malur, PC

(57) ABSTRACT

A water level control system for enhancing the controllability of the level of water retained in a steam drum. A water level control section of the system determines the volume of retained water in a steam-water separator from a detected steam flow rate signal by using a function operator and a first order lag circuit, determines a signal representing the mass flow rate balance of water in the steam-water separator by differentiating the volume of retained water with respect to time with a differentiator, generates a compensated signal by adding the signal to the difference between a detected feed water flow rate signal and the detected steam flow rate signal, and properly compensates a valve area demand for a feed water flow control valve.

13 Claims, 10 Drawing Sheets

LIQUID LEVEL CONTROL SYSTEM

BACKGROUND OF THE INVENTION

1. Field of the Invention

The present invention relates to a liquid level control system, and more particularly to a system for controlling the level of liquid stored in a steam drum containing a steam-liquid separator that separates liquid from two-phase fluid containing steam and liquid generated in a boiler.

2. Description of the Related Art

Power stations, such as thermal or nuclear power stations, generate steam by heating water or other liquid with a boiler, and obtain electrical power by driving a turbine and an electric generator with the generated steam. In most cases, however, the steam generated by the boiler is a two-phase flow that contains steam and water (liquid/mist).

Meanwhile, the turbine, which uses steam, needs dry steam, which is water-free, in order to maintain its soundness. Therefore, there is a known method for introducing the two-phase flow, which is generated in the boiler, into a steam drum, separating water from the two-phase flow with steam-water separators mounted in the steam drum, and forwarding the water-free steam to the turbine.

The water separated by the steam-water separators is retained in the steam drum. Further, a feed-water pump supplies water from a steam condenser to the steam drum in order to balance with the flow rate of steam flowing to the turbine. The separated water retained in the steam drum and the water fed from the steam condenser are both supplied to the boiler.

If, for instance, the output of electric power by a power station is changed or the load on the power station is suddenly decreased or lost, the flow rate of steam flowing from the steam drum to the turbine rapidly changes. The balance between a feed water flow rate and steam flow rate then becomes impaired to change the volume of water in the steam drum, thereby causing the water level to change.

However, the water level in the steam drum has to be maintained within a predetermined range for the following reasons:

(1) If the water level is raised, the steam flowing into the turbine contains a large quantity of moisture (mist) due to the characteristics of the steam-water separators. This may cause damage to the turbine.

(2) If the water level is lowered, the resulting exposed portion of the boiler is dried out. This may cause damage to the boiler.

In view of the above circumstances, a known technology disclosed, for instance, in JP-5-265569-A makes it possible to detect the level of water retained in the steam drum, the flow rate of water fed from the steam condenser to the steam drum, and the flow rate of steam fed from the steam drum to the turbine, and adjust the water level in the steam drum to a predetermined level by regulating the flow rate of water fed from the steam condenser in accordance with the above three detected signals.

SUMMARY OF THE INVENTION

However, the technology disclosed in JP-H05-265569-A leaves room for improvement because the controllability of water level in the steam drum can be further increased.

More specifically, the technology disclosed in JP-5-265569-A determines a rate of water level change in the steam drum with respect to time from the difference between the feed water flow rate and steam flow rate (flow rate balance). However, it is a mass balance that is determined with a steam drum container wall regarded as a boundary. The actual water level may also be affected by a steam drum's internal element other than the balance between the feed water flow rate and steam flow rate.

For example, the steam drum includes a steam-water separator. The water level in the steam drum fluctuates due to changes in the volume of water retained in a portion of the steam-water separator that is positioned above the water level in the steam drum. Further, the water level in the steam drum also fluctuates due to changes in the total volume of voids contained in the water in the boiler and steam drum.

The present invention has been made in view of the above circumstances. An object of the present invention is to enhance the controllability of the level of liquid retained in the steam drum.

A liquid level control system according to the present invention includes a boiler, which boils liquid; a steam-liquid separator, which separates the liquid from two-phase fluid that contains steam and liquid flowing out of the boiler and allows the separated liquid to fall; a steam drum, which contains the steam-liquid separator, supplies the liquid-free steam to a turbine, and supplies the internally retained liquid to the boiler; a feed liquid flow rate adjustment section, which is capable of adjusting the flow rate of feed liquid supplied from a steam condenser to the steam drum; a level meter for detecting the liquid level of the liquid retained in the steam drum; a flowmeter for detecting the feed liquid flow rate of the feed liquid supplied from the steam condenser to the steam drum; a flowmeter for detecting the steam flow rate of the steam supplied from the steam drum to the turbine; and a liquid level control section, which uses the feed liquid flow rate adjustment section to control the feed liquid flow rate in accordance with the detected liquid level, feed liquid flow rate, and steam flow rate.

To achieve the above object, the liquid level control section according to the present invention particularly determines the change rate of the volume of liquid (voids included) retained in the steam-liquid separator, and allows the feed liquid flow rate adjustment section to compensate the feed liquid flow rate in accordance with the determined change rate of the volume of liquid.

In other words, the fluctuation of the liquid level in the steam drum can be discovered by determining the change rate of the volume of the liquid retained in the steam-liquid separator. Therefore, the feed liquid flow rate adjustment section can properly compensate the feed liquid flow rate in accordance with the change rate of the volume of the liquid.

It should be noted that the feed liquid flow rate adjustment section can adjust the flow rate of the feed liquid supplied from the steam condenser to the steam drum by controlling at least either the revolution speed of a feed-liquid pump for supplying the feed liquid from the steam condenser to the steam drum or the valve area of a flow control valve for the feed liquid. In this instance, the liquid level control section can be configured so as to determine the change rate of the volume of the liquid retained in the steam-liquid separator and compensate at least either the revolution speed of the feed-liquid pump or the valve area of the flow control valve in accordance with the determined change rate of the volume of the liquid.

When, for instance, the change rate of the volume of the liquid retained in the steam-liquid separator indicates that the liquid level in the steam drum will rise, the feed water flow rate should be reduced either by decreasing the revolution speed of the feed-liquid pump or by decreasing the valve area of the flow control valve. When, on the other hand, the change rate of the volume of the liquid retained in the steam-liquid separator indicates that the liquid level in the steam drum will lower, the feed water flow rate should be increased either by increasing the revolution speed of the feed-liquid pump or by increasing the valve area of the flow control valve. As described above, the controllability, that is, the stability or readiness, of the liquid level in the steam drum can be enhanced by adjusting the feed water flow rate while considering a factor of changing the liquid level in the steam drum, which is a factor other than the difference between the feed water flow rate and steam flow rate for the steam drum (flow rate balance).

In the above instance, a flowmeter for detecting the flow rate of the liquid flowing from the boiler to the steam-liquid separator and a flowmeter for detecting the flow rate of the liquid flowing from the steam-liquid separator to a liquid-phase section of the steam drum can be installed to determine the change rate of the volume of the liquid retained in the steam-liquid separator, that is, the balance ratio between the steam drum and the steam-liquid separator in accordance with the difference between the detected flow rate of the liquid flowing into the steam-liquid separator and the flow rate of the liquid flowing from the steam-liquid separator to the liquid-phase section of the steam drum plus the steam flow rate of the steam supplied to the turbine.

Further, a level meter for detecting the liquid level of the liquid in the steam-liquid separator can be installed to determine the volume of liquid to be retained in the steam-liquid separator in accordance with the detected liquid level in the steam-liquid separator and determine the change rate of the volume of liquid to be retained in the steam-liquid separator in accordance with the determined volume of liquid.

Moreover, it is possible to determine the volume of liquid to be retained in the steam-liquid separator in accordance with the flowmeter-detected steam flow rate of the steam supplied from the steam drum to the turbine and determine the change rate of the volume of liquid to be retained in the steam-liquid separator in accordance with the determined volume of liquid. In this instance, it is possible to correct the volume of liquid to be retained in the steam-liquid separator, which is determined in accordance with the level-meter-detected liquid level of liquid retained in the steam drum.

To achieve the above object, another aspect of the liquid level control section according to the present invention determines the change ratio of the total volume of voids in liquid retained in the boiler and steam drum, and allows the feed liquid flow rate adjustment section to compensate the feed liquid flow rate in accordance with the determined change ratio of the total volume of voids.

In other words, the fluctuation of the liquid level in the steam drum can be discovered by determining the change ratio of the total volume of voids in the liquid in the boiler and steam drum. Therefore, the feed liquid flow rate adjustment section can properly compensate the feed liquid flow rate in accordance with the change ratio of the volume of the voids. If, for instance, the change ratio of the volume of the voids indicates that the liquid level in the steam drum will rise in a situation where the feed liquid flow rate adjustment section adjusts the flow rate of the feed liquid supplied from the steam condenser to the steam drum by controlling at least either the revolution speed of the feed liquid pump or the valve area of the feed liquid flow control valve, the feed water flow rate should be reduced either by decreasing the revolution speed of the feed liquid pump or by decreasing the valve area of the flow control valve. If, on the other hand, the change ratio of the volume of the voids indicates that the liquid level in the steam drum will lower, the feed water flow rate should be increased either by increasing the revolution speed of the feed-water pump or by increasing the valve area of the flow control valve. As described above, the controllability of the liquid level in the steam drum can be enhanced by adjusting the feed water flow rate while considering a factor of changing the liquid level in the steam drum, which is a factor other than the difference between the feed water flow rate and steam flow rate for the steam drum (flow rate balance).

The change ratio of the volume of the voids in the liquid in the boiler and steam drum can be determined in accordance with the thermal power of a heat source for the boiler. When, for instance, the boiler is of an exhaust gas heat recovery type, a thermometer for detecting an exhaust gas temperature before heat recovery, a thermometer for detecting an exhaust gas temperature after heat recovery, and a flowmeter for detecting the flow rate of an exhaust gas can be installed to determine the thermal power of exhaust gas heat in accordance with the detected exhaust gas temperature prevailing before heat recovery, exhaust gas temperature prevailing after heat recovery, and exhaust gas flow rate.

The present invention makes it possible to enhance the controllability of the liquid level of liquid retained in the steam drum.

DETAILED DESCRIPTION OF THE PREFERRED EMBODIMENTS

Figure 1:
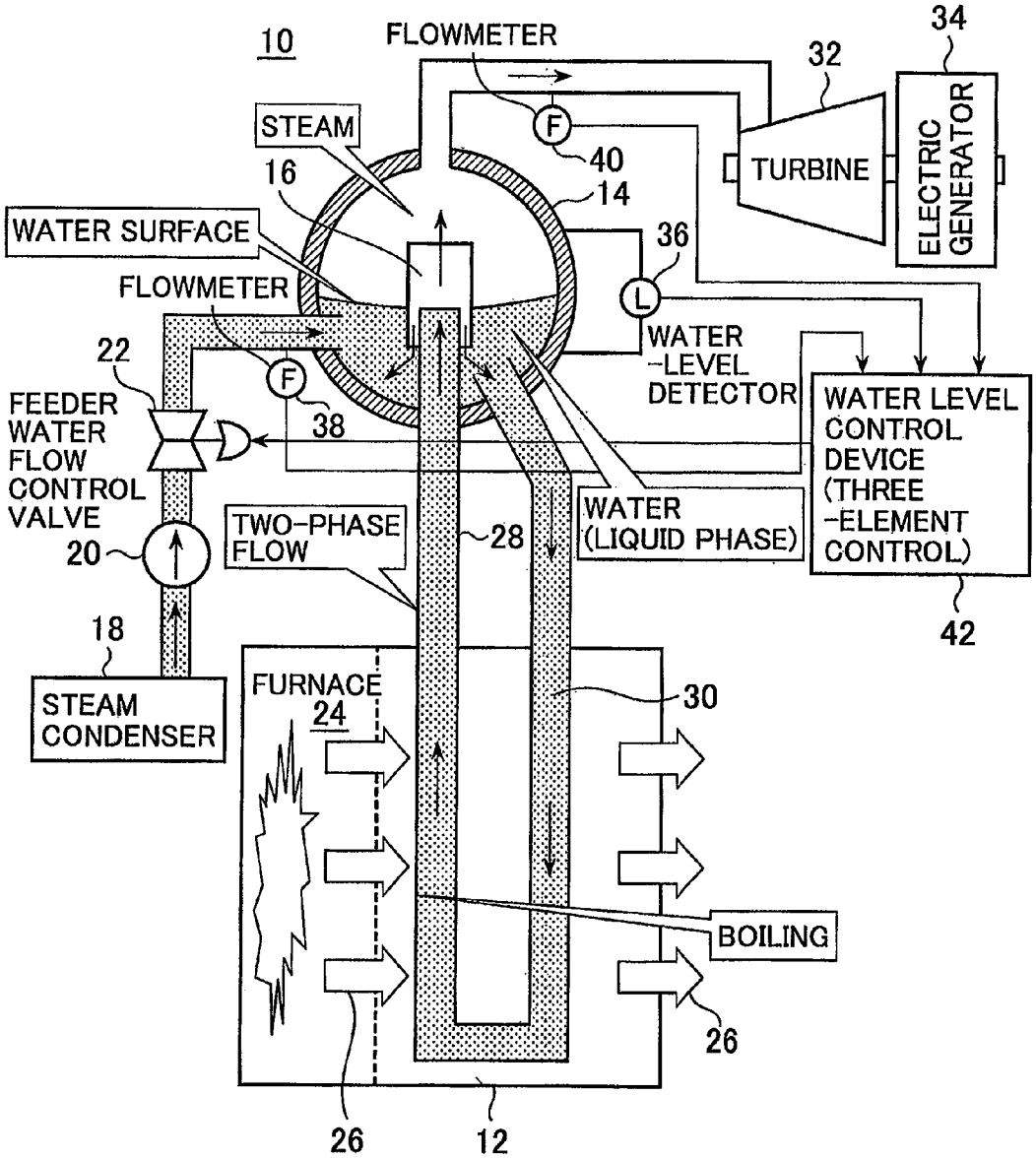
FIG. 1 is a schematic diagram illustrating the basic configuration of a water level control system according to the present invention.

Embodiments of a water level control system according to the present invention will now be described. In the following description, elements having the same functions are designated by the same reference numerals and will not be repeatedly described. First of all, the basic configuration of the water level control system according to the present invention will be described. The present invention will be described with reference to a water level control system for a steam drum used at a thermal power station. However, it should be noted that the present invention is applicable not only to thermal power stations but also to nuclear power stations (where a boiling water reactor and/or a steam generator are used), nuclear fusion power stations, geothermal power stations, waste power stations, solar thermal power stations, and other power stations that generate steam to drive a turbine and an electric generator.

FIG. 1 is a schematic diagram illustrating the basic configuration of a water level control system according to the present invention. As shown in FIG. 1, the water level control system 10 according to the present invention includes a boiler 12 which boils water or other liquid, a steam drum 14 into which two-phase fluid containing steam and water (liquid) generated in the boiler 12 flows, a steam-water separator 16 mounted in the steam drum 14, and a feed water flow control valve 22 capable of adjusting the flow rate of feed water which is supplied from a steam condenser 18 to the steam drum 14 through a feed-water pump 20. A feed liquid flow rate adjustment section may be installed instead of the feed water flow control valve 22 to adjust the flow rate of the feed water by regulating the revolution speed of the feed-water pump 20.

The boiler 12 boils water by using the heat of an exhaust gas 26 supplied from a furnace 24. A flow path of the exhaust gas 26 is provided with an ascending pipe 28, one end of which is open to the steam drum 14. The other end of the ascending pipe 28 is in communication with one end of a downcomer 30, the other end of which is open to the bottom of the steam drum 14. This ensures that water retained in the steam drum 14 is introduced into the ascending pipe 28 through the downcomer 30, heated and boiled by the exhaust gas 26 in the ascending pipe 28, and conveyed to the steam drum 14 as an ascending two-phase flow.

The steam-water separator 16 separates water from the two-phase fluid, which flows inward from the boiler 12 through the ascending pipe 28, and allows the separated water to drop. Steam from which the water is separated by the steam-water separator 16 is supplied to a turbine 32 through a steam flow path, one end of which is open to the upper part of the steam drum 14, and used to drive the turbine 32 and an electric generator 34. Meanwhile, the water, which is separated by the steam-water separator 16 and dropped, is retained to form a water surface at a predetermined water level within the steam drum 14 together with feed water supplied from the steam condenser 18, and introduced into the boiler 12 through the downcomer 30 due to natural circulation caused by thermal power in the boiler 12.

The feed water flow control valve 22 adjusts the flow rate of the feed water, which is supplied from the steam condenser 18 to the steam drum 14 through the feed-water pump 20. More specifically, the feed water flow control valve 22 adjusts the flow rate of the feed water supplied to the steam drum 14 in such a manner as to balance with the flow rate of steam supplied from the steam drum 14 to the turbine 32.

Incidentally, the water level in the steam drum 14 has to be maintained within a predetermined range for the following reasons:

(1) If the water level is raised, the steam flowing into the turbine contains a large quantity of moisture (mist) due to the characteristics of the steam-water separator. This may cause damage to the turbine.

(2) If the water level is lowered, the resulting exposed portion of the boiler is dried out. This may cause damage to the boiler.

Figure 2:
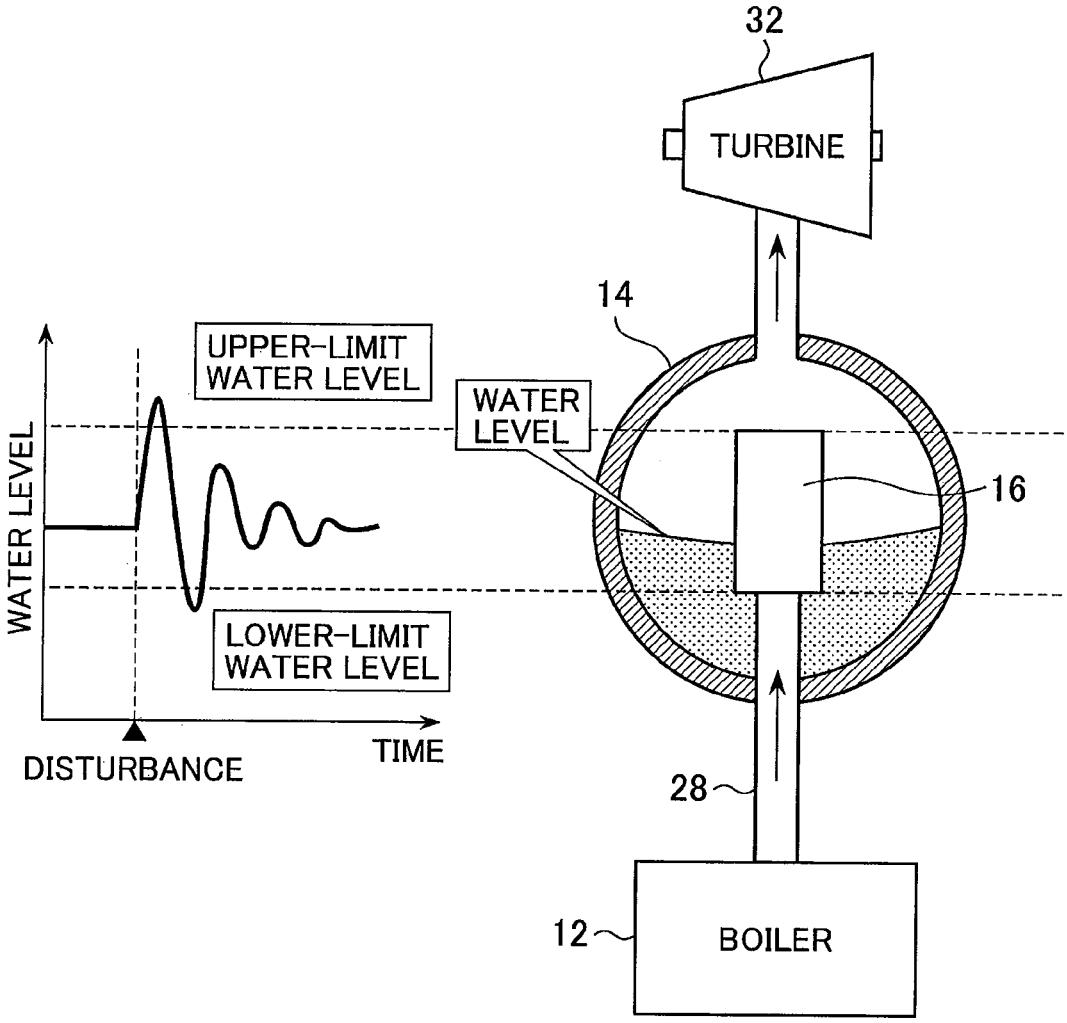
FIG. 2 shows an example indicating that the water level in a steam drum changes with time when a disturbance occurs to significantly change the output of power generation or the load.

However, if, for instance, the output of electric power by a power station is changed or the load on the power station is suddenly decreased or lost, the flow rate of steam flowing from the steam drum 14 to the turbine 32 rapidly changes. The balance between the feed water flow rate and steam flow rate then becomes impaired to change the volume of water in the steam drum 14, thereby causing the water level to fluctuate. FIG. 2 shows an example indicating that the water level in the steam drum 14 changes with time when a disturbance occurs to significantly change the output of power generation or the load. As shown in FIG. 2, the water level significantly fluctuates in the event of a disturbance. In some cases, the water level may exceed a predefined upper-limit water level or lower-limit water level. The load on a power station may suddenly decrease due, for instance, to FCB (fast cut back) or boiler input sudden change limitation control.

The water level control system 10 according to the present invention includes a water-level detector 36 for detecting the level of water retained in the steam drum 14, a flowmeter 38 for detecting the flow rate of feed liquid supplied from the steam condenser 18 to the steam drum 14, a flowmeter 40 for detecting the flow rate of steam supplied from the steam drum 14 to the turbine 32, and a water level control section 42 for controlling the valve area of the feed water flow control valve 22 in accordance with the water level, feed water flow rate, and steam flow rate detected respectively by the water-level detector 36, flowmeter 38, and flowmeter 40. The water level control section 42 provides so-called three-element water level control.

Figure 3:
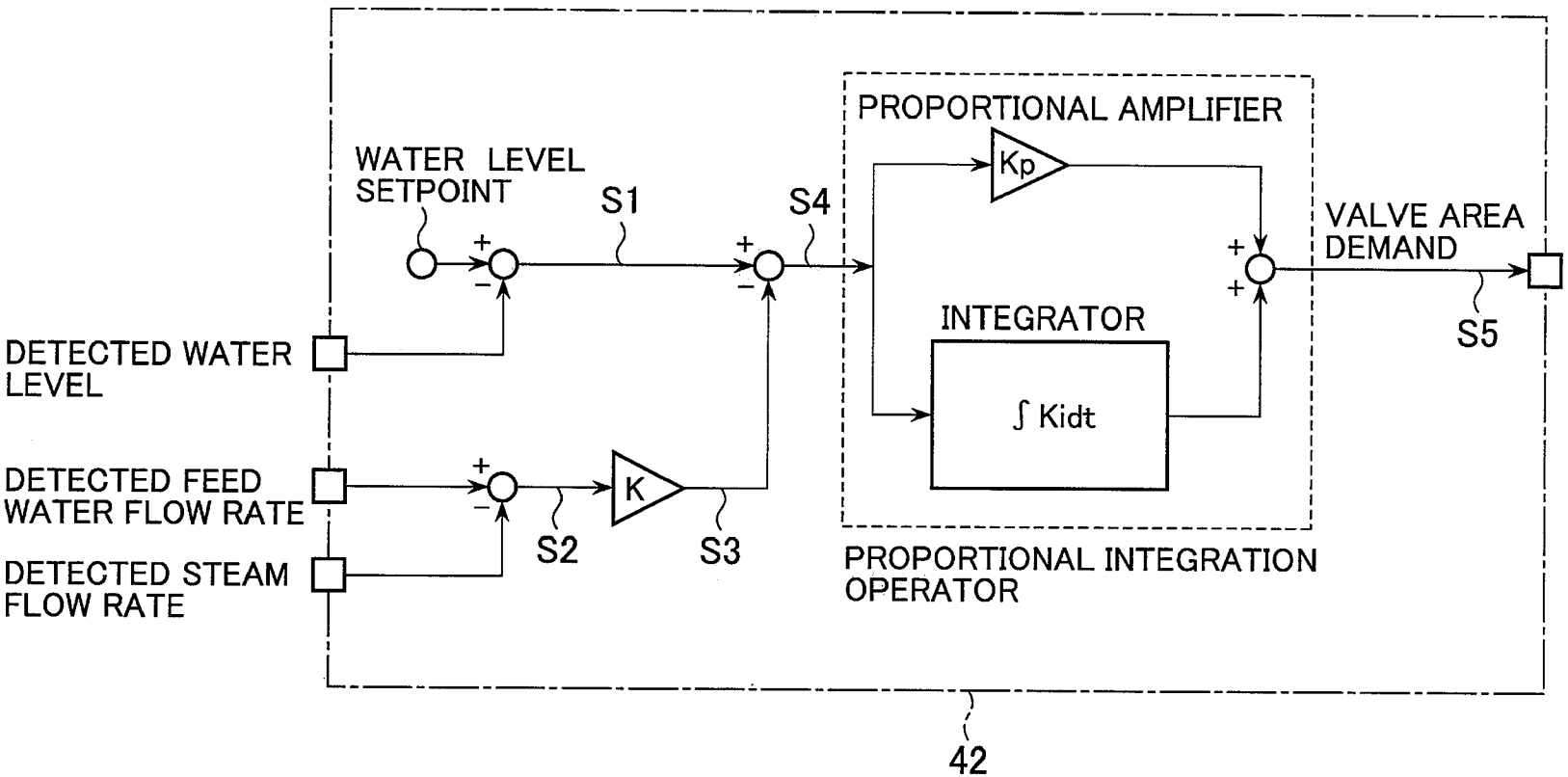
FIG. 3 is a diagram illustrating the calculation algorithm of a water level control section.

FIG. 3 is a diagram illustrating the calculation algorithm of the water level control section 42. As shown in FIG. 3, the water level control section 42 determines a deviation signal (S1) that indicates the deviation between a target water level (water level setpoint) in the steam drum 14 and a water level detected by the water-level detector 36. Meanwhile, the water level control section 42 calculates a deviation signal (S2) that indicates the difference between a detected feed water flow rate signal and a detected steam flow rate signal, and determines a signal (S3) by amplifying the calculated deviation signal with an amplifier having a gain of K. A deviation signal (S4), which indicates the difference between the deviation signal (S1) and signal (S3), is then calculated by a proportional-integral operator to determine a valve area demand (S5). In other words, the deviation between the target water level in the steam drum 14 and the water level in the steam drum 14 that is detected by the water-level detector 36 is compensated in accordance with the difference between the feed liquid flow rate and steam flow rate.

It should be noted that the detected signal indicating the flow rate of feed water flowing into the steam drum 14 and the detected signal indicating the flow rate of steam flowing into the turbine 32 are used for water level control in order to provide improved readiness for control.

A method frequently used for determining the water level in the steam drum 14 is to measure a differential pressure with a differential pressure gauge installed between upper and lower holes in the steam drum 14 as shown in FIG. 1 and convert the measured differential pressure to the water level. However, a large volume of water is injected into a liquid-phase section in the steam drum 14 from the feed-water pump 20 and steam-water separator 16. In addition, buoyant voids contained in the steam drum 14 come up within the steam drum 14. Therefore, internal water flowage and water level changes in the steam drum 14 are complicated. Consequently, not only the primary information about a water level but also high-frequency noise and fluctuation are persistently superimposed over a water level signal to be measured.

Meanwhile, a proportional gain and an integration gain, which are used for proportional integration operation, have to be set so that the water level shows a stable and prompt response. However, the water level in the steam drum exhibits a complicated behavior as described earlier so that the measured water level persistently fluctuates. Therefore, if priority is given to readiness, for instance, by setting the proportional gain and integration gain to great values, an untoward effect will be produced as the actual water level fluctuates in addition to the valve area and feed water flow rate.

Consequently, if the output of electric power by a power station is drastically changed or the load on the power station is suddenly decreased or lost, it is conceivable that the response to water level control may be inadequate, causing the water level to exceed a predetermined range. The horizontal free section area of the steam drum 14, that is, the size of the steam drum 14, could be increased to avoid the above problem. However, it is unfavorable because there is a demand for reduction in the size of the steam drum. In addition, it also makes it difficult to rapidly change the output of power generation by the power station.

It should be noted that the water level in the steam drum 14 is positively correlated with the volume of water in the boiler 12 and steam drum 14. Therefore, the rate of water level change with respect to time is equivalent to the ratio of water volume change in the boiler 12 and steam drum 14 with respect to time, that is, a flow rate balance. Consequently, when a value obtained by multiplying the rate of water level change with respect to time by the horizontal free section area of the steam drum 14 and the mass density of water is used as the deviation signal (S2) indicating the flow rate difference for three-element water level control, the ratio of water volume change with respect to time, which will contribute to the water level change, could be determined with increased accuracy.

In reality, however, noise and fluctuation are persistently superimposed over a measured water level signal. Therefore, if the water level signal is differentiated with respect to time, a spike-shaped signal is persistently superimposed over the differentiated signal. Consequently, when such a signal is used for water level control operation, the associated valve area demand persistently changes. As a result, proper control cannot be provided because the valve area, feed water flow rate, and steam drum water level greatly fluctuate. Further, a low-pass filter could be used to reduce noise and fluctuation. However, the use of such a low-pass filter is inappropriate because it impairs readiness for control, thereby losing the advantage of providing the above-described control.

The water level control system 10 according to the present invention not only provides the above-described three-element water level control, but also enhances the controllability of the water level in the steam drum 14. As described earlier, the three-element water level control is exercised to determine the rate of water level change in the steam drum 14 with respect to time from the difference between the feed water flow rate and steam flow rate (flow rate balance). However, it is a mass balance that is determined with the container wall of the steam drum 14 regarded as a boundary. The actual water level may also be affected by a steam drum's internal element other than the balance between the feed water flow rate and steam flow rate. The water level control system 10 according to the present invention is provided with the above finding taken into account.

A change in the volume of water retained in a portion of the steam-water separator that is positioned above the water surface in the steam drum 14 may be regarded as an internal factor for the steam drum 14 that affects the water level in the steam drum 14 in addition to the balance between the feed water flow rate and steam flow rate.

Figure 4:
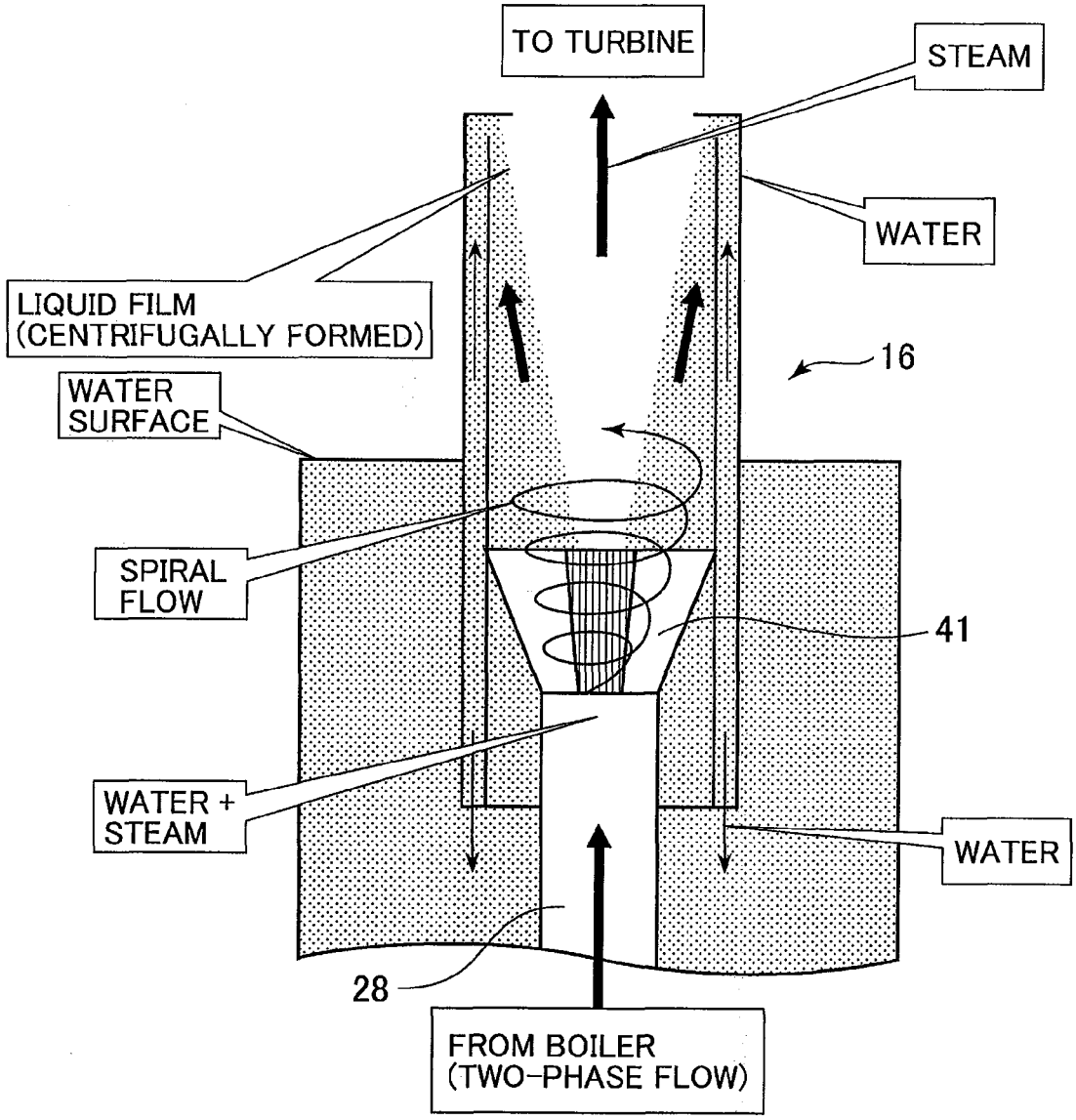
FIG. 4 is a diagram illustrating the configuration of a steam-water separator.
Figure 5:
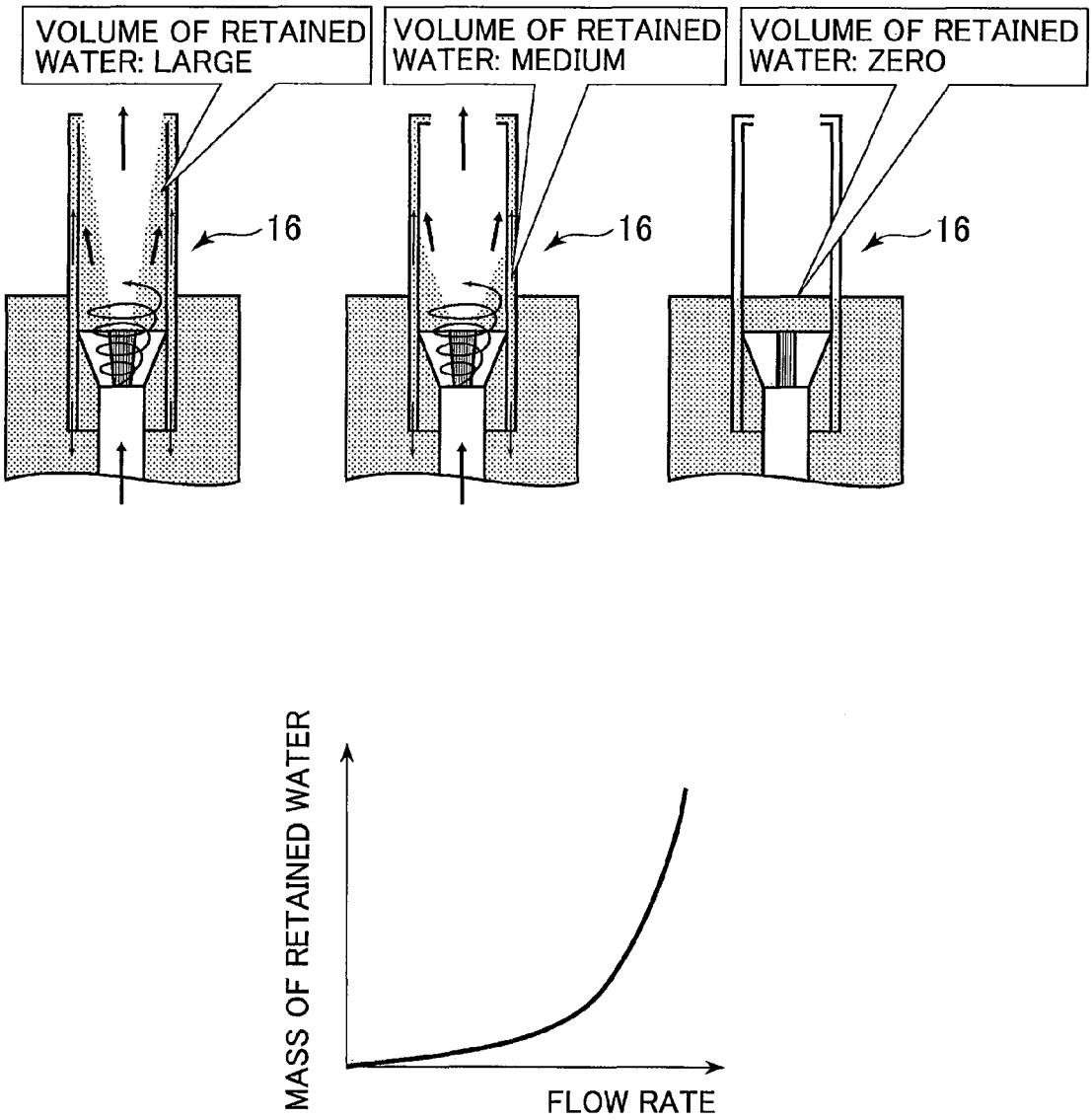
FIG. 5 contains diagrams illustrating how the volume of water in the steam-water separator changes when there is a change in the flow rate of steam flowing into the steam-water separator.

FIG. 4 is a diagram illustrating the configuration of the steam-water separator 16 used in the water level control system 10 according to the present invention. FIG. 5 contains diagrams illustrating how the volume of water in the steam-water separator changes when there is a change in the flow rate of steam flowing into the steam-water separator. As shown in FIG. 4, the steam-water separator 16 is configured as a swirl steam-water separator that centrifugally separates the water by raising two-phase fluid in a spiral manner.

When the steam-water separator 16 is of a swirl type, the two-phase fluid, which flows inward through the ascending pipe 28 of the boiler 12, is rotated by the action of a spiral vane 41 as shown in FIG. 4. The water in the two-phase flow is then separated from the steam so that the steam remains at the center with the water removed to the outside. Thus, the steam at the center escapes upward, whereas the water is centrifugally captured by a cylindrical wall of the steam-water separator 16 and then lowered to flow into the steam drum. Consequently, the water separated by the steam-water separator 16 is retained in the steam-water separator.

As shown in FIG. 5, the volume of water retained in the steam-water separator tends to increase or decrease with an increase or decrease in the flow rate of two-phase fluid flowing into the steam-water separator 16 or of steam flowing toward the turbine 32. Therefore, if the flow rate decreases, the water in the steam-water separator 16 flows out to the main body of the steam drum 14, thereby raising the water level in the steam drum 14.

Consequently, when the flow rate of water flowing from the steam-water separator 16 to the steam drum 14 is measured or estimated to add the resulting signal to the difference signal for three-element control, the ratio of water volume change with respect to time, which contributes to the water level, can be determined with increased accuracy. This makes it possible to provide excellent water level control. In view of these circumstances, the water level control section 42 according to the present invention determines the change rate of the volume of liquid (voids included) retained in the steam-water separator 16 and compensates the valve area of the feed water flow control valve 22 in accordance with the determined change rate of the volume of the liquid. Various preferred embodiments are presented below to describe a characteristic portion of the water level control system 10 according to the present invention.

The description of the present invention assumes that a swirl steam-water separator is used. Alternatively, however, a screen, slit plate, netting, or other component provided in a two-phase fluid flow path in the steam drum may be used to separate the water from the two-phase fluid and allow the water to drop into the liquid-phase section. In short, the present invention is applicable to a component that increases or decreases the volume of water retained in the steam-water separator in accordance with an increase or decrease in the flow rate of two-phase fluid flowing into the steam-water separator or of steam flowing toward the turbine. Further, when the steam drum includes a plurality of steam-water separators, the preferred embodiments are also applicable to each steam-water separator.

First Embodiment

Figure 6:
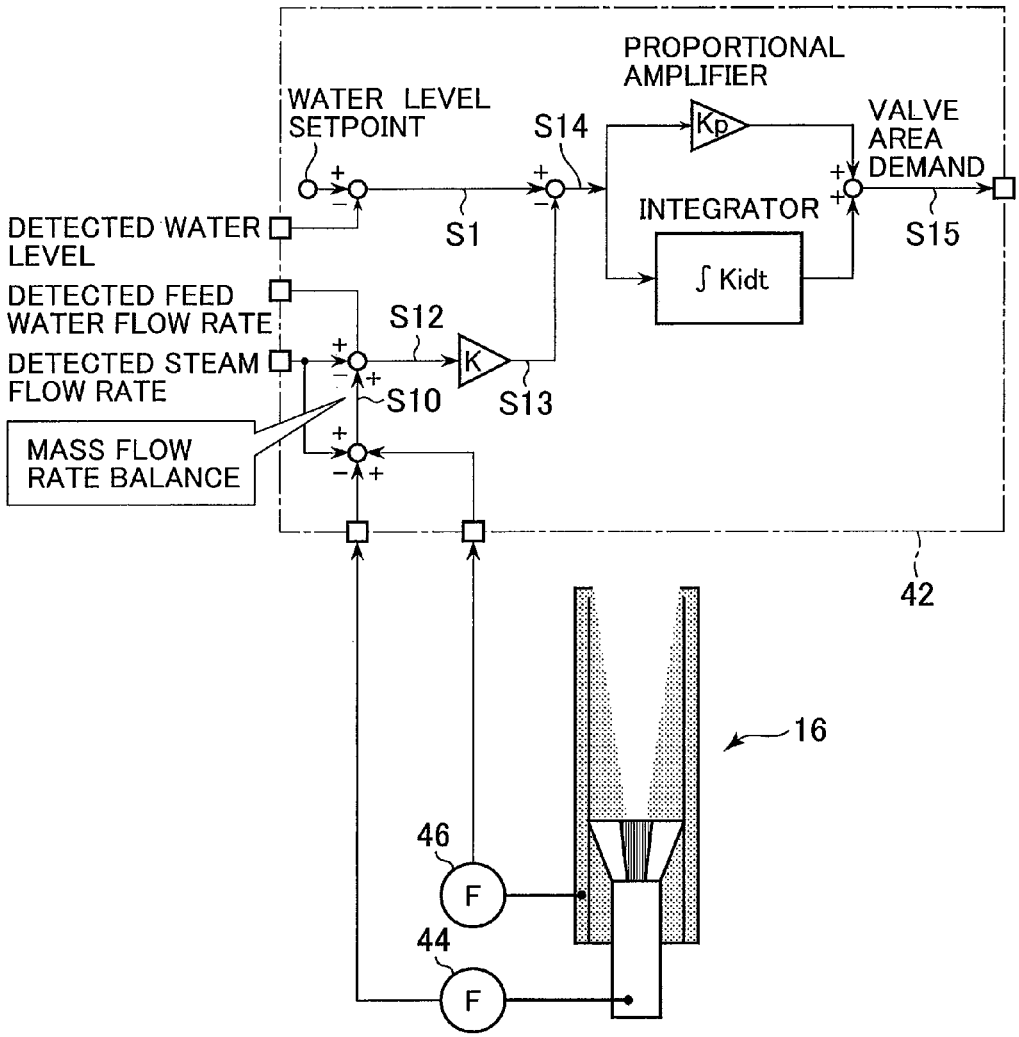
FIG. 6 is a diagram illustrating the configuration of a characteristic portion of the water level control system according to a first embodiment of the present invention.

FIG. 6 is a diagram illustrating the configuration of a characteristic portion of the water level control system 10 according to a first embodiment of the present invention. In the first embodiment, the inlet of the swirl steam-water separator 16 is provided with a flowmeter 44 for measuring the flow rate of two-phase fluid, whereas a water outlet is provided with a flowmeter 46. Flow rate signals measured by the flowmeters 44 and 46 are entered into the water level control section 42.

The present embodiment determines the change rate of the volume of water retained in the steam-water separator 16 in accordance with the difference between the flow rate of liquid flowing from the boiler 12 to the steam-water separator 16 and the flow rate of liquid flowing from the steam-water separator 16 to the liquid-phase section of the steam drum 14 plus the flow rate of steam supplied to the turbine 32.

The water level control section 42 determines the deviation signal (S1) that indicates the deviation between a target water level (water level setpoint) in the steam drum 14 and a water level detected by the water-level detector 36. Meanwhile, the water level control section 42 determines a signal (S10) representing the mass flow rate balance of water in the steam-water separator 16 (the change rate of the volume of water retained in the steam-water separator 16) in accordance with the difference between the flow rate of liquid flowing into the steam-water separator 16 and the flow rate of liquid flowing from the steam-water separator to the liquid-phase section of the steam drum 14 plus the flow rate of steam supplied to the turbine 32. The water level control section 42 then determines a compensated signal (S12) by adding the determined signal (S10) to the difference between a detected feed water flow rate signal and a detected steam flow rate signal, and determines a signal (S13) by amplifying the compensated signal (S12) with an amplifier having a gain of K. Further, the water level control section 42 determines a valve area demand (S15) by operating on a deviation signal (S14) representing the difference between the deviation signal (S1) and the signal (S13) with the proportional-integral operator.

As described above, the present embodiment makes it possible to estimate the rate of water level change in the steam drum 14 with respect to time with increased accuracy by determining the change rate of the volume of water retained in the steam-water separator 16. As the water level fluctuation in the steam drum 14 can be determined with increased accuracy, the valve area of the feed water flow control valve 22 can be properly compensated by compensating the difference between the feed liquid flow rate and steam flow rate.

If, for instance, the change rate of the volume of water retained in the steam-water separator 16 indicates that the water level in the steam drum 14 will rise, the valve area should be decreased to lower the feed water flow rate. If, on the other hand, it is indicated that the liquid level in the steam drum 14 will lower, the valve area should be increased to raise the feed water flow rate. As described above, the controllability of water level in the steam drum 14 can be enhanced by adjusting the feed water flow rate while considering a factor of changing the liquid level in the steam drum 14, which is a factor other than the difference between the feed water flow rate and steam flow rate for the steam drum 14 (flow rate balance). Consequently, even if the output of power generation or the load is drastically changed, the water level fluctuation in the steam drum 14 can be suppressed.

The present embodiment and the subsequent embodiments assume that the feed water flow rate is controlled by adjusting the valve area of the feed water flow control valve 22. Alternatively, however, the feed water flow rate can be controlled by adjusting the revolution speed of the feed-water pump 20. This alternative eliminates the necessity of installing the feed water flow control valve 22. If, for instance, the change rate of the volume of water retained in the steam-water separator 16 indicates that the water level in the steam drum 14 will rise, the feed water flow rate should be decreased by lowering the revolution speed of the feed-water pump 20. If, on the other hand, it is indicated that the liquid level in the steam drum 14 will lower, the feed water flow rate should be increased by raising the revolution speed of the feed-water pump 20. Further, the feed water flow rate can also be controlled by adjusting the valve area of the feed water flow control valve 22 and the revolution speed of the feed-water pump 20 in a coordinated manner.

A modification of the present embodiment is to determine the compensated signal (S12) by adding the difference between the flow rate of the liquid flowing to the steam-water separator 16 and the flow rate of the liquid flowing from the steam-water separator to the liquid-phase section of the steam drum 14 to the detected feed water flow rate signal. This modification eliminates the necessity of using the detected steam flow rate signal (the flow rate of the steam supplied to the turbine 32).

Second Embodiment

Figure 7:
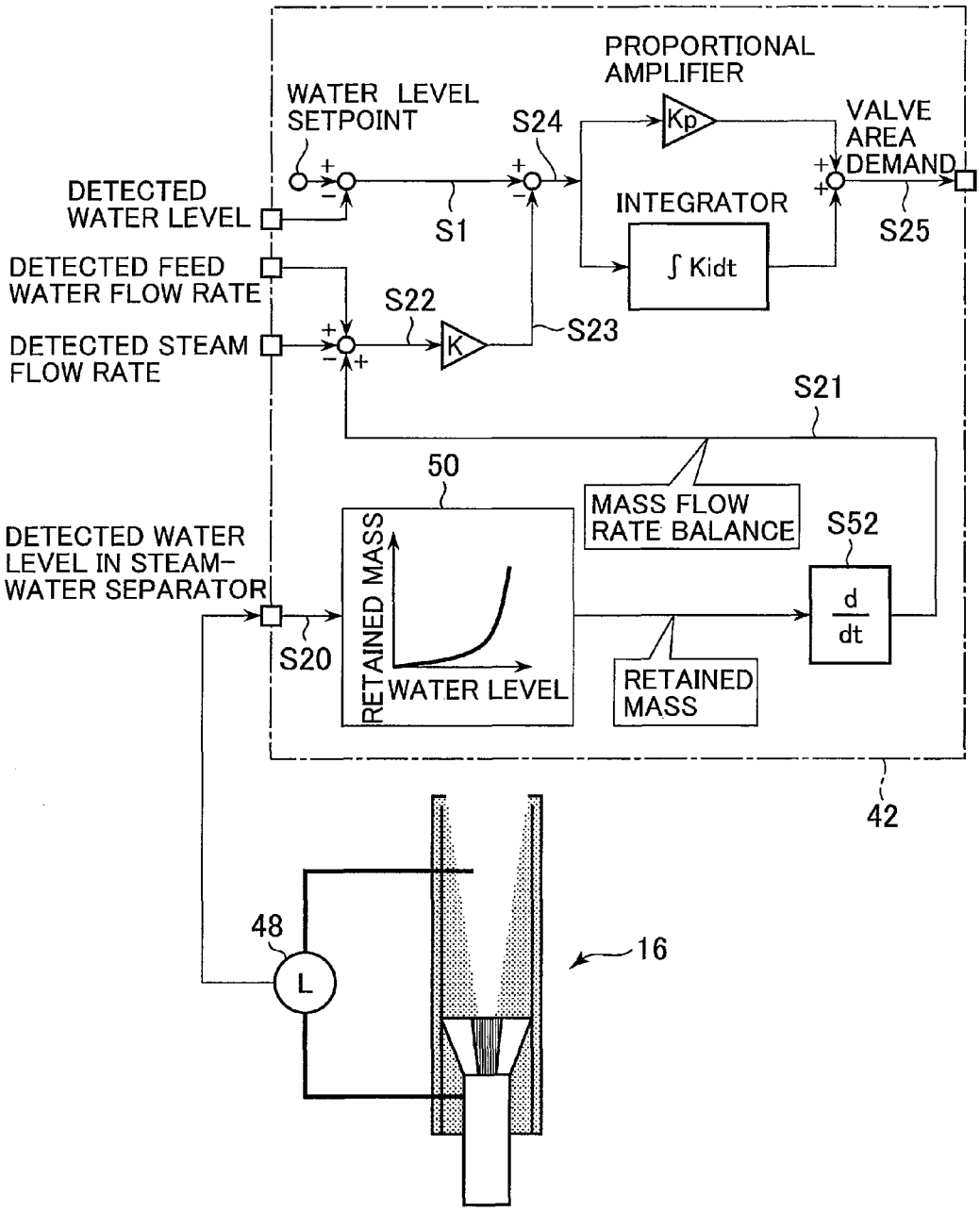
FIG. 7 is a diagram illustrating the configuration of a characteristic portion of the water level control system according to a second embodiment of the present invention.

FIG. 7 is a diagram illustrating the configuration of a characteristic portion of the water level control system 10 according to a second embodiment of the present invention. The second embodiment includes a water-level detector 48 for detecting the water level of water retained in the steam-water separator 16. A water level signal measured by the water-level detector 48 enters the water level control section 42. The present embodiment determines the volume of water to be retained in the steam-water separator 16 in accordance with the water level in the steam-water separator 16, and then determines the change rate of the volume of water to be retained in the steam-water separator 16 in accordance with the determined volume of the water.

The water level control section 42 determines the deviation signal (S1) that indicates the deviation between the target water level (water level setpoint) in the steam drum 14 and the water level detected by the water-level detector 36. Meanwhile, the water level control section 42 determines the volume of retained water in the steam-water separator 16 from a water level signal (S20), which indicates the water level in the steam-water separator 16, by using a function operator 50, and then determines a signal (S21) indicating the mass flow rate balance of water in the steam-water separator 16 (the change rate of the volume of water retained in the steam-water separator 16) by differentiating the volume of retained water with respect to time with a differentiator 52. Next, the water level control section 42 determines a compensated signal (S22) by adding the signal (S21) to the difference between the detected feed water flow rate signal and the detected steam flow rate signal, and then determines a signal (S23) by amplifying the compensated signal (S22) with an amplifier having a gain of K. Further, the water level control section 42 determines a valve area demand (S25) by operating on a difference signal (S24) representing the difference between the deviation signal (S1) and the signal (S23) with the proportional-integral operator.

The function operator 50 indicates the correlation between the water level in the steam-water separator 16 and the volume of retained water in the steam-water separator 16. The correlation characteristic of the function operator 50 can be preset after determining it, for instance, through a fluid analysis or an experiment.

As described above, the present embodiment makes it possible to estimate the rate of water level change in the steam drum 14 with respect to time with increased accuracy by determining the change rate of the volume of water retained in the steam-water separator 16. As the water level fluctuation in the steam drum 14 can be determined with increased accuracy, the valve area of the feed water flow control valve 22 can be properly compensated by compensating the difference between the feed liquid flow rate and steam flow rate.

Third Embodiment

Figure 8:
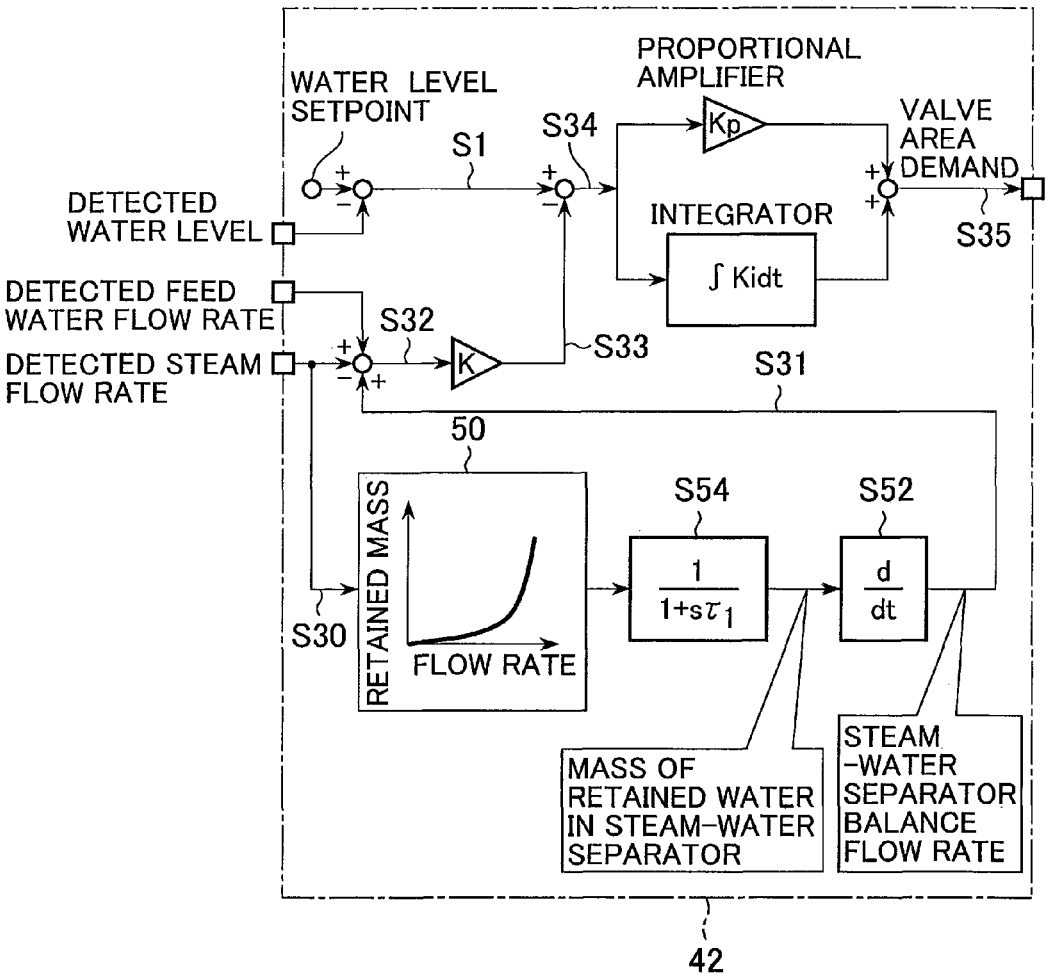
FIG. 8 is a diagram illustrating the configuration of a characteristic portion of the water level control system according to a third embodiment of the present invention.

FIG. 8 is a diagram illustrating the configuration of a characteristic portion of the water level control system 10 according to a third embodiment of the present invention. The third embodiment determines the volume of water to be retained in the steam-water separator 16 in accordance with the flow rate of steam supplied from the steam drum 14 to the turbine 32, which is detected by the flowmeter 40, and then determines the change rate of the volume of water to be retained in the steam-water separator 16 in accordance with the determined volume of the water.

The water level control section 42 determines the deviation signal (S1) that indicates the deviation between the target water level (water level setpoint) in the steam drum 14 and the water level detected by the water-level detector 36. Meanwhile, the water level control section 42 determines the volume of retained water in the steam-water separator 16 from a detected steam flow rate signal (S30) by using the function operator 50 and a first order lag circuit 54, and determines a signal (S31) representing the mass flow rate balance of water in the steam-water separator 16 (the change rate of the volume of water retained in the steam-water separator 16) by differentiating the volume of retained water with respect to time with the differentiator 52. The water level control section 42 then determines a compensated signal (S32) by adding the signal (S31) to the difference between the detected feed water flow rate signal and the detected steam flow rate signal, and determines a signal (S33) by amplifying the compensated signal (S32) with an amplifier having a gain of K. Next, the water level control section 42 determines a valve area demand (S35) by operating on a deviation signal (S34) representing the difference between the deviation signal (S1) and the signal (S33) with the proportional-integral operator.

The function operator 50 indicates the correlation between the flow rate of the steam supplied to the turbine 32 and the volume of retained water in the steam-water separator 16. The correlation characteristic of the function operator 50 can be preset after determining it, for instance, through a fluid analysis or an experiment. The volume of retained water in the steam-water separator 16 changes with a delay from time change with respect to the Steam flow rate due to its inertia because the water in the steam-water separator 16 is in rotary movement. Therefore, the present embodiment uses the first order lag circuit 54 to process the volume calculated by the function operator 50. The time constant for such processing can be preset after determining it, for instance, through a fluid analysis or an experiment.

As described above, the present embodiment makes it possible to estimate the rate of water level change in the steam drum 14 with respect to time with increased accuracy by determining the change rate of the volume of water retained in the steam-water separator 16. As the water level fluctuation in the steam drum 14 can be determined with increased accuracy, the valve area of the feed water flow control valve 22 can be properly compensated by compensating the difference between the feed liquid flow rate and steam flow rate. Further, the water level control system according to the present embodiment is superior to a conventional three-element water level control system because the former eliminates the necessity of installing an additional sensor such as a flowmeter or water-level detector.

Fourth Embodiment

Figure 9:
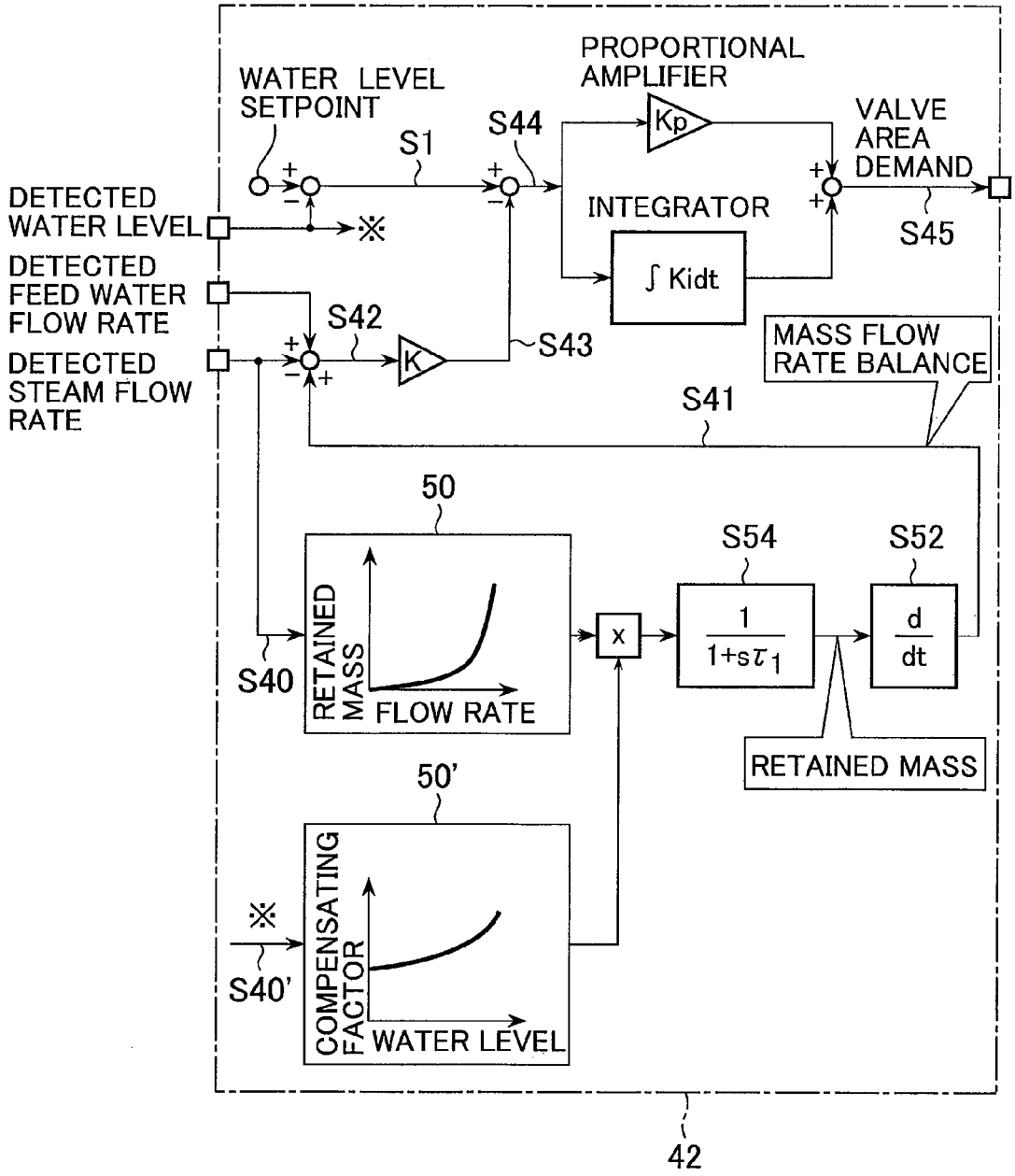
FIG. 9 is a diagram illustrating the configuration of a characteristic portion of the water level control system according to a fourth embodiment of the present invention.

FIG. 9 is a diagram illustrating the configuration of a characteristic portion of the water level control system 10 according to a fourth embodiment of the present invention. In accordance with the water level of water retained in the steam drum, which is detected by the water-level detector 36, the fourth embodiment compensates the volume of water to be retained in the steam-water separator 16, which is, as described in conjunction with the third embodiment, determined in accordance with the flow rate of steam supplied from the steam drum 14 to the turbine 32, the flow rate being detected by the flowmeter 40. In short, the fourth embodiment is an improved version of the third embodiment.

The third embodiment determines the volume of retained water in the steam-water separator 16 from the steam flow rate. However, the steam flow rate is also affected by the water level prevailing outside the steam-water separator 16. In view of such circumstances, the fourth embodiment compensates the volume of retained water in the steam-water separator 16, which is determined in accordance with the steam flow rate, on the basis of the water level in the steam drum 14.

The water level control section 42 determines the deviation signal (S1) that indicates the deviation between the target water level (water level setpoint) in the steam drum 14 and the water level detected by the water-level detector 36. Meanwhile, in relation to a signal obtained by operating on a detected steam flow rate signal (S40) with the function operator 50, the water level control section 42 compensates a water level signal (S40') representing the water level in the steam drum 14 by multiplying it with a signal obtained by a function operator 50'. The water level control section 42 then determines the volume of retained water in the steam-water separator 16 by operating on the compensated signal with the first order lag circuit 54, and determines a signal (S41) representing the mass flow rate balance of water in the steam-water separator 16 (the change rate of the volume of water retained in the steam-water separator 16) by differentiating the volume of retained water with respect to time with the differentiator 52. The water level control section 42 then determines a compensated signal (S42) by adding the signal (S41) to the difference between the detected feed water flow rate signal and the detected steam flow rate signal, and determines a signal (S43) by amplifying the compensated signal (S42) with an amplifier having a gain of K. Next, the water level control section 42 determines a valve area demand (S45) by operating on a difference signal (S44) representing the difference between the deviation signal (S1) and the signal (S43) with the proportional-integral operator.

The function operator 50 indicates the correlation between the flow rate of the steam supplied to the turbine 32 and the volume of retained water in the steam-water separator 16. The correlation characteristic of the function operator 50 can be preset after determining it, for instance, through a fluid analysis or an experiment. The function operator 50' indicates the correlation between the water level in the steam drum 14 and a compensating factor. The correlation characteristic of the function operator 50' can be preset after determining it, for instance, through a fluid analysis or an experiment.

As described above, the present embodiment makes it possible to estimate the rate of water level change in the steam drum 14 with respect to time with increased accuracy by determining the change rate of the volume of water retained in the steam-water separator 16. As the water level fluctuation in the steam drum 14 can be determined with increased accuracy, the valve area of the feed water flow control valve 22 can be properly compensated by compensating the difference between the feed liquid flow rate and steam flow rate. Further, the water level control system according to the present embodiment is superior to a conventional three-element water level control system because the former eliminates the necessity of installing an additional sensor such as a flowmeter or water-level detector. In addition, the present embodiment makes it possible to estimate the rate of water level change in the steam drum 14 with respect to time with higher accuracy than the third embodiment because the compensation provided by the present embodiment is based on the water level in the steam drum 14.

Fifth Embodiment

A change in the volume of steam voids in the boiler 12 and steam drum 14 (below the water surface) may be regarded as an internal factor for the steam drum 14 that affects the water level in the steam drum 14 in addition to the balance between the feed water flow rate and steam flow rate. In the boiler 12 and steam drum 14, a region below the water surface contains steam voids. If the volume of such steam voids increases to increase the total volume, the water level rises. If, on the other hand, the volume of steam voids decreases to decrease the total volume, the water level lowers.

In view of the above circumstances, a fifth embodiment of the present invention determines the change ratio of the total volume of voids in the water within the boiler 12 and steam drum 14, and compensates the valve area of the feed water flow control valve 22 in accordance with the determined change ratio of the total volume of voids. More specifically, as the total volume of voids is positively correlated with the thermal power of the boiler 12, the fifth embodiment determines the change ratio of the total volume of voids in accordance with the thermal power of the boiler 12, and compensates the valve area of the feed water flow control valve 22 in accordance with the change ratio of the total volume of voids.

Figure 10:
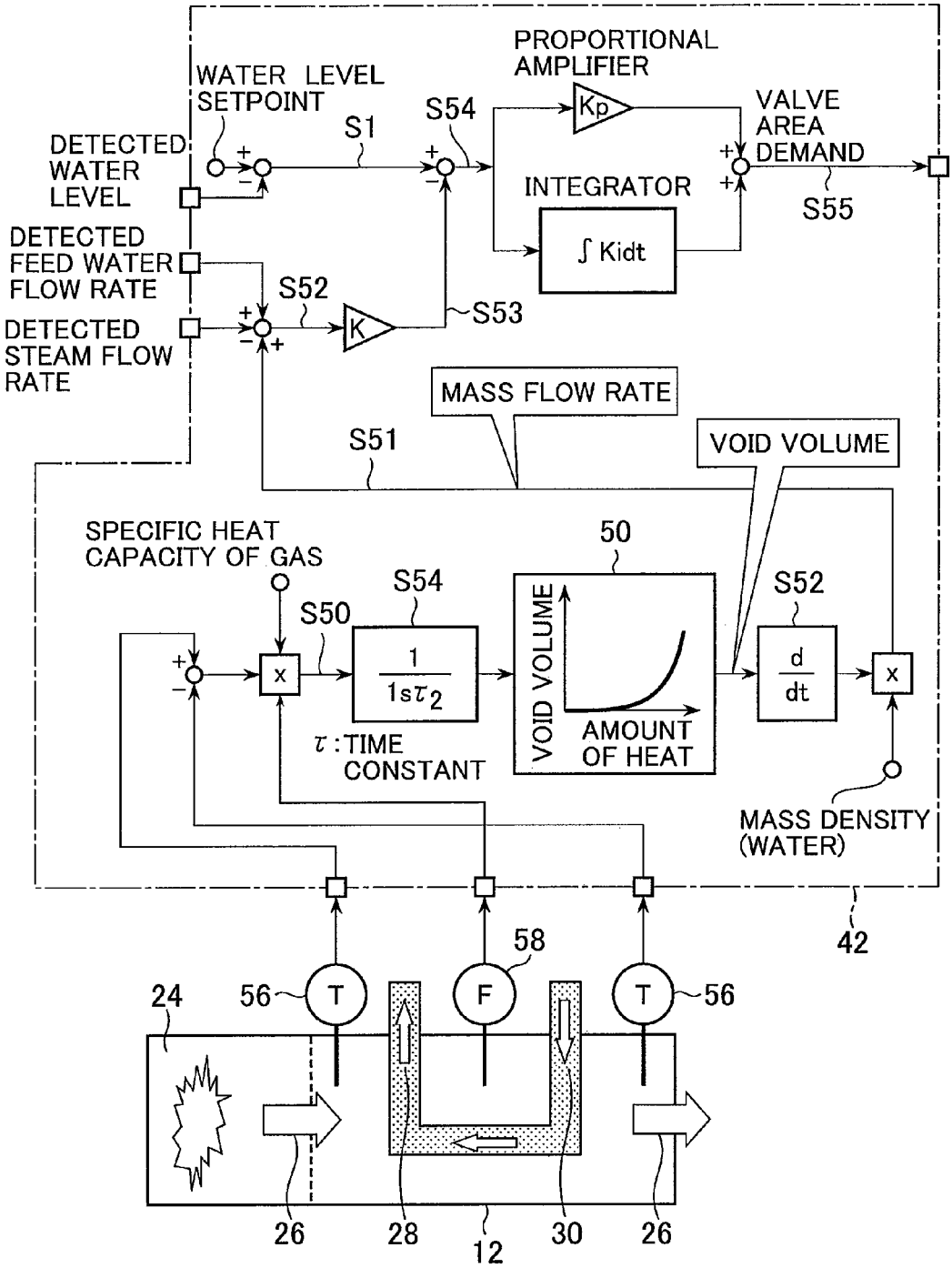
FIG. 10 is a diagram illustrating the configuration of a characteristic portion of the water level control system according to a fifth embodiment of the present invention.

FIG. 10 is a diagram illustrating the configuration of a characteristic portion of the water level control system 10 according to the fifth embodiment. As shown in FIG. 10, the inlet and outlet of the boiler 12 are each provided with a thermometer 56. The thermometers 56 measure the temperature of the exhaust gas that prevails before heat recovery or after heat recovery. Further, the boiler 12 is provided with a flowmeter 58 for measuring the flow rate of the exhaust gas flowing from the boiler 12. The present embodiment assumes that the boiler 12 is of an exhaust heat recovery type, which does not generate any internal heat. The exhaust gas temperatures detected by the thermometers 56 and the exhaust gas flow rate detected by the flowmeter 58 are all entered into the water level control section 42.

The water level control section 42 determines the deviation signal (S1) that indicates the deviation between the target water level (water level setpoint) in the steam drum 14 and the water level detected by the water-level detector 36. Meanwhile, the water level control section 42 calculates the thermal power entering the boiler 12 in accordance with FIG. 10 and the equation shown below, and determines a signal (S50) concerning the thermal power. (Thermal power)={(boiler inlet exhaust gas temperature)−(boiler outlet exhaust gas temperature)}×(specific heat capacity of exhaust gas)×(volume flow rate of exhaust gas) The specific heat capacity of the exhaust gas, which is included in the above equation, is the product of exhaust gas mass density and constant pressure specific heat.

If the thermal power entered into the boiler 12 is changed, it takes some time for the flow rate of generated steam to change due, for instance, to the specific heat of materials of the boiler 12. To simulate such a lag, therefore, the present embodiment uses the first order lag circuit 54 to process the signal (S50) concerning the thermal power that has entered the boiler 12.

Here, the total volume of voids in the boiler 12 and steam drum 14 (the volume of steam positioned below the water surface in the steam drum 14) increases with an increase in the thermal power of the boiler 12, thereby raising the water level. Therefore, the function operator 50 is used to calculate the total volume of voids in the boiler 12 and steam drum 14 from the thermal power that has entered the boiler 12. The characteristic of the function operator 50 can be preset after determining it, for instance, through a fluid analysis or an experiment.

Next, the calculated total volume of voids is differentiated with respect to derivative time with the differentiator 52. The result of differentiation is then multiplied by the mass density of water to determine a signal (S51) that represents the flow rate of water flowing into the steam drum 14. Next, the signal (S51) is added to the difference between the detected feed water flow rate signal and the detected steam flow rate signal to determine a compensated signal (S52). The determined compensated signal (S52) is then amplified by an amplifier having a gain of K to determine a signal (S53). Finally, a valve area demand (S55) is determined by operating on a difference signal (S54) representing the difference between the deviation signal (S1) and the signal (S53) with the proportional-integral operator.

The present embodiment makes it possible to estimate the rate of water level change in the steam drum 14 with respect to time with increased accuracy by determining the change ratio of the total volume of voids in the water in the boiler 12 and steam drum 14. As the water level fluctuation in the steam drum 14 can be determined, the valve area of the feed water flow control valve 22 can be properly compensated in accordance with the change ratio of the total volume of voids.

If, for instance, the change ratio of the total volume of voids indicates that the liquid level in the steam drum 14 will rise, the feed water flow rate should be decreased by decreasing the valve area. If, on the other hand, it is indicated that the liquid level in the steam drum 14 will lower, the feed water flow rate should be increased by increasing the valve area. As described above, the controllability of the liquid level in the steam drum 14 can be enhanced by adjusting the feed water flow rate while considering a factor of changing the liquid level in the steam drum 14, which is a factor other than the difference between the feed water flow rate and steam flow rate for the steam drum 14 (flow rate balance). Consequently, even if the output of power generation or the load is drastically changed, the water level fluctuation in the steam drum 14 can be suppressed.

As an alternative to the above-described thermal power measurement method, the thermal power can also be estimated from the flow rate of fuel supplied to a burner of the boiler 12. In the case of nuclear power generation or nuclear-fusion power generation, the intended purpose can be accomplished by detecting the level of neutron flux with a neutron detector. When, for instance, a fast (breeder) reactor flows sodium to the primary side of a heat exchanger and supplies water to the secondary side to obtain steam, the thermal power can be calculated from a sodium temperature difference between the inlet and outlet of the heat exchanger and the flow rate of the sodium. In the case of solar thermal power generation, the intensity of optical radiation on the boiler 12 should be used. In the case of a waste power station, the thermal power can be measured in the same manner as for a thermal power station.

What is claimed is:

1. A liquid level control system comprising:

a boiler which boils liquid;

a steam-liquid separator which separates the liquid from two-phase fluid containing steam and liquid flowing out of the boiler and allows the separated liquid to fall;

a steam drum which contains the steam-liquid separator, supplies the liquid-free steam to a turbine, and supplies the internally retained liquid to the boiler;

feed liquid flow rate adjustment means which is capable of adjusting the flow rate of feed liquid supplied from a steam condenser to the steam drum;

a level meter for detecting a liquid level of the liquid retained in the steam drum;

a flowmeter for detecting a feed liquid flow rate of the feed liquid supplied from the steam condenser to the steam drum;

a flowmeter for detecting a steam flow rate of the steam supplied from the steam drum to the turbine; and liquid level control means which uses the feed liquid flow rate adjustment means to control the feed liquid flow rate in accordance with the detected liquid level, feed liquid flow rate, and steam flow rate;

wherein the liquid level control means determines a change rate of the volume of liquid retained in the steam-liquid separator, and allows the feed liquid flow rate adjustment means to compensate the feed liquid flow rate in accordance with the determined change rate of the volume of liquid.

2. The liquid level control system according to claim 1, wherein the feed liquid flow rate adjustment means adjusts the flow rate of the feed liquid supplied from the steam condenser to the steam drum by controlling at least either a revolution speed of a feed-liquid pump for supplying the feed liquid from the steam condenser to the steam drum or a valve area of a flow control valve for the feed liquid; and wherein the liquid level control means determines the change rate of the volume of the liquid retained in the steam-liquid separator and compensates at least either the revolution speed of the feed-liquid pump or the valve area of the flow control valve in accordance with the determined change rate of the volume of the liquid.

3. The liquid level control system according to claim 1, further comprising:

a flowmeter for detecting a flow rate of the liquid flowing from the boiler to the steam-liquid separator; and a flowmeter for detecting a flow rate of the liquid flowing from the steam-liquid separator to a liquid-phase section of the steam drum;

wherein the liquid level control means determines the change rate of the volume of the liquid retained in the steam-liquid separator in accordance with the difference between the detected flow rate of the liquid flowing into the steam-liquid separator and the flow rate of the liquid flowing from the steam-liquid separator to the liquid-phase section of the steam drum plus the steam flow rate of the steam supplied to the turbine.

4. The liquid level control system according to claim 1, further comprising:

a level meter for detecting a liquid level of liquid in the steam-liquid separator;

wherein the liquid level control means determines the volume of liquid to be retained in the steam-liquid separator in accordance with the detected liquid level in the steam-liquid separator, and determines the change rate of the volume of liquid to be retained in the steam-liquid separator in accordance with the determined volume of liquid.

5. The liquid level control system according to claim 1, wherein the liquid level control means determines the volume of liquid to be retained in the steam-liquid separator in accordance with the flowmeter-detected steam flow rate of the steam supplied from the steam drum to the turbine, and determines the change rate of the volume of liquid to be retained in the steam-liquid separator in accordance with the determined volume of liquid.

6. The liquid level control system according to claim 5, wherein the liquid level control means compensates the volume of liquid to be retained in the steam-liquid separator, which is determined in accordance with the level-meter-detected liquid level of liquid retained in the steam drum.

7. The liquid level control system according to claim 1, wherein the liquid level control means controls the feed liquid flow rate to be provided by the feed liquid flow rate adjustment means in accordance with a deviation between a target liquid level in the steam drum and the level-meter-detected liquid level of liquid retained in the steam drum, and compensates the deviation in accordance with a difference between the feed liquid flow rate and the steam flow rate; and wherein the difference between the feed liquid flow rate and the steam flow rate is compensated in accordance with the change rate of the volume of liquid to be retained in the steam-liquid separator.

8. The liquid level control system according to claim 1, wherein the steam-liquid separator is a swirl steam-liquid separator that centrifugally separates the liquid by raising the two-phase fluid in a spiral manner.

9. A liquid level control system comprising:

a boiler which boils liquid;

a steam-liquid separator which separates the liquid from two-phase fluid containing steam and liquid flowing out of the boiler and allows the separated liquid to fall;

a steam drum which contains the steam-liquid separator, supplies the liquid-free steam to a turbine, and supplies the internally retained liquid to the boiler;

feed liquid flow rate adjustment means which is capable of adjusting the flow rate of feed liquid supplied from a steam condenser to the steam drum;

a level meter for detecting a liquid level of the liquid retained in the steam drum;

a flowmeter for detecting a feed liquid flow rate of the feed liquid supplied from the steam condenser to the steam drum;

a flowmeter for detecting a steam flow rate of the steam supplied from the steam drum to the turbine; and liquid level control means which uses the feed liquid flow rate adjustment means to control the feed liquid flow rate in accordance with the detected liquid level, feed liquid flow rate, and steam flow rate;

wherein the liquid level control means determines a change ratio of the total volume of voids in liquid retained in the boiler and the steam drum, and allows the feed liquid flow rate adjustment means to compensate the feed liquid flow rate in accordance with the determined change ratio of the total volume of voids.

10. The liquid level control system according to claim 9, wherein the feed liquid flow rate adjustment means adjusts the flow rate of the feed liquid to be supplied from the steam condenser to the steam drum by controlling at least either a revolution speed of a feed-liquid pump for supplying the feed liquid from the steam condenser to the steam drum or a valve area of a flow control valve for the feed liquid; and wherein the liquid level control means determines the change rate of the volume of the voids in the liquid in the boiler and the steam drum, and compensates at least either the revolution speed of the feed-liquid pump or the valve area of the flow control valve in accordance with the determined change rate of the volume of the voids.

11. The liquid level control system according to claim 9, wherein the liquid level control means determines the change ratio of the total volume of voids in the liquid in the boiler and the steam drum in accordance with a thermal power of a heat source for the boiler.

12. The liquid level control system according to claim 11, wherein the boiler is an exhaust gas heat recovery boiler, and includes a thermometer for detecting a temperature of an exhaust gas before heat recovery, a thermometer for detecting a temperature of the exhaust gas after heat recovery, and a flowmeter for detecting a flow rate of the exhaust gas; and wherein the liquid level control means determines the thermal power of exhaust gas heat in accordance with the detected exhaust gas temperature prevailing before heat recovery, exhaust gas temperature prevailing after heat recovery, and exhaust gas flow rate.

13. The liquid level control system according to claim 9, wherein the liquid level control means controls the feed liquid flow rate to be provided by the feed liquid flow rate adjustment means in accordance with a deviation between a target liquid level in the steam drum and the level-meter-detected liquid level of liquid retained in the steam drum, and compensates the deviation in accordance with a difference between the feed liquid flow rate and the steam flow rate; and wherein the difference between the feed liquid flow rate and the steam flow rate is compensated in accordance with a result obtained by multiplying the change ratio of the total volume of voids in the liquid in the boiler and the steam drum by a mass density of the liquid.

* * * * *